US005689854A

United States Patent [19]

Wang

[11] Patent Number: 5,689,854

[45] Date of Patent: Nov. 25, 1997

[54] ROTATABLE HANDLE ASSEMBLY FOR A SUITCASE

[76] Inventor: Jing Sheng Wang, No. 569, Ging Guo Road, Da Gia Town, Taichung Hsien, Taiwan

[21] Appl. No.: 672,974

[22] Filed: Jul. 1, 1996

[51] Int. Cl.[6] ..... A47B 95/02

[52] U.S. Cl. ..... 16/115; 190/115

[58] Field of Search ..... 16/112, 115; 190/117, 190/115, 39

[56] References Cited

U.S. PATENT DOCUMENTS 5,464,081 11/1995 Zwanzig ..... 190/115
5,491,872 2/1996 Tseng ..... 190/115
5,497,865 3/1996 Yun-Pi ..... 190/39
5,500,981 3/1996 Ho ..... 16/115

*Primary Examiner*—Chuck Y. Mah
*Assistant Examiner*—Mark Williams
*Attorney, Agent, or Firm*—Charles E. Baxley, Esq.

[57] ABSTRACT

A rotatable handle assembly includes a housing having a pair of casings for rotatably receiving a pair of barrels. A pair of tubes are slidably engaged in the housing and slidably engaged in the barrels such that the tubes are rotated in concert with the barrels. The tube and the barrel may rotate relative to the casing when the lower end of the tube is disengaged from the casing and is received in the barrel. The casings each includes a projection for engaging with one or more cavities of the barrel so as to position the barrel at an angular position relative to the casing.

7 Claims, 7 Drawing Sheets

ROTATABLE HANDLE ASSEMBLY FOR A SUITCASE

BACKGROUND OF THE INVENTION

1. Field of the Invention

The present invention relates to a handle, and more particularly to a rotatable handle assembly for a suitcase.

2. Description of the Prior Art

Typical suitcases comprise a handle that may be retracted and may be extended outward for use. However, the handle includes a retractable configuration only and may not be rotated.

The present invention has arisen to mitigate and/or obviate the afore-described disadvantages of the conventional handles for suitcases.

SUMMARY OF THE INVENTION

The primary objective of the present invention is to provide a handle assembly for a suitcase in which the handle assembly may be rotated to different angular positions.

In accordance with one aspect of the invention, there is provided a rotatable handle assembly for a suitcase, the handle assembly comprises a housing for engaging in the suitcase, the housing including a room formed therein and including a pair of casings formed therein, the casings each including a chamber formed therein, a pair of barrels rotatably received in the chambers of the casings, the barrels each including an orifice formed therein, a pair of tubes slidably received in the room, the tubes each including a lower portion slidably engaged through the orifice of the barrel so as to allow the tube to be rotated in concert with the barrel, and a handle secured on top of the tubes for operating the tubes.

The casings each includes a conduit extended downward therefrom for receiving the tube, the tube and the barrel are allowed to rotate relative to the casing when the lower portion of the tube is disengaged from the conduit and when the lower portion of the tube is received in the barrel.

The barrel includes a center portion having a bore formed therein and includes an aperture formed therein and radially spaced from the bore, the tubes each includes a spring biased latch engaged therein for engaging with the bore when the lower portion of the tube is engaged in the conduit and for engaging with the aperture when the lower portion of the tube is disengaged from the conduit.

The lower portions of the tubes each includes a lid secured thereto, the lids each includes a peripheral flange formed thereon for engaging with the barrel so as to prevent the tubes from disengaging from the barrel and the housing.

The barrels each includes an end portion having at least one cavity formed therein, the casings each includes a projection means provided therein for engaging with the cavity so as to position the barrel at an angular position relative to the casing.

The barrels each includes an end portion having a plurality of depressions formed therein, the casings each includes at least one bulge provided therein for engaging with the depressions so as to position the barrel at an angular position relative to the casing.

The casing includes at least one puncture formed therein, the handle includes a beam received therein and movable upward and downward and includes a biasing means for biasing the beam downward, the handle includes a hand grip secured to the beam and extendible downward and outward of the handle for moving the beam upward against the biasing means, the handle, the handle assembly further includes at least one pole slidably received in a first of the tubes, the pole includes an upper end secured to the beam so as to be moved upward and downward by the beam, the pole includes a lower end extended through the barrel for engaging with the puncture so as to position the barrel at an angular position relative to the casing.

The barrels each includes a swelling extended outward therefrom, the casings each includes a stop formed thereon for engaging with the swelling of the barrel so as to limit a rotational movement of the barrel relative to the casing.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
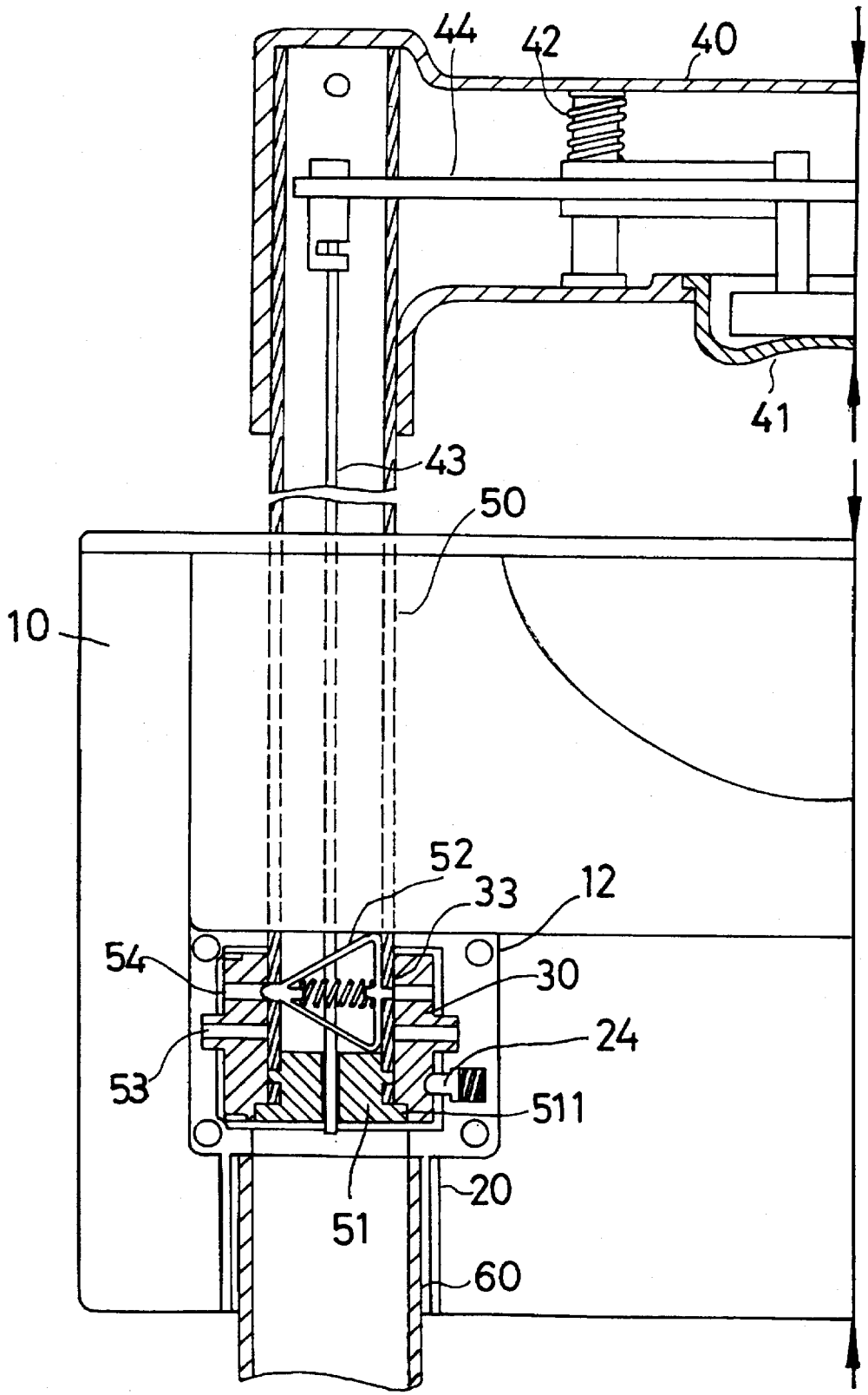
FIG. 1 is a partial cross sectional view of a rotatable handle assembly for a suitcase in accordance with the present invention.
Figure 2:
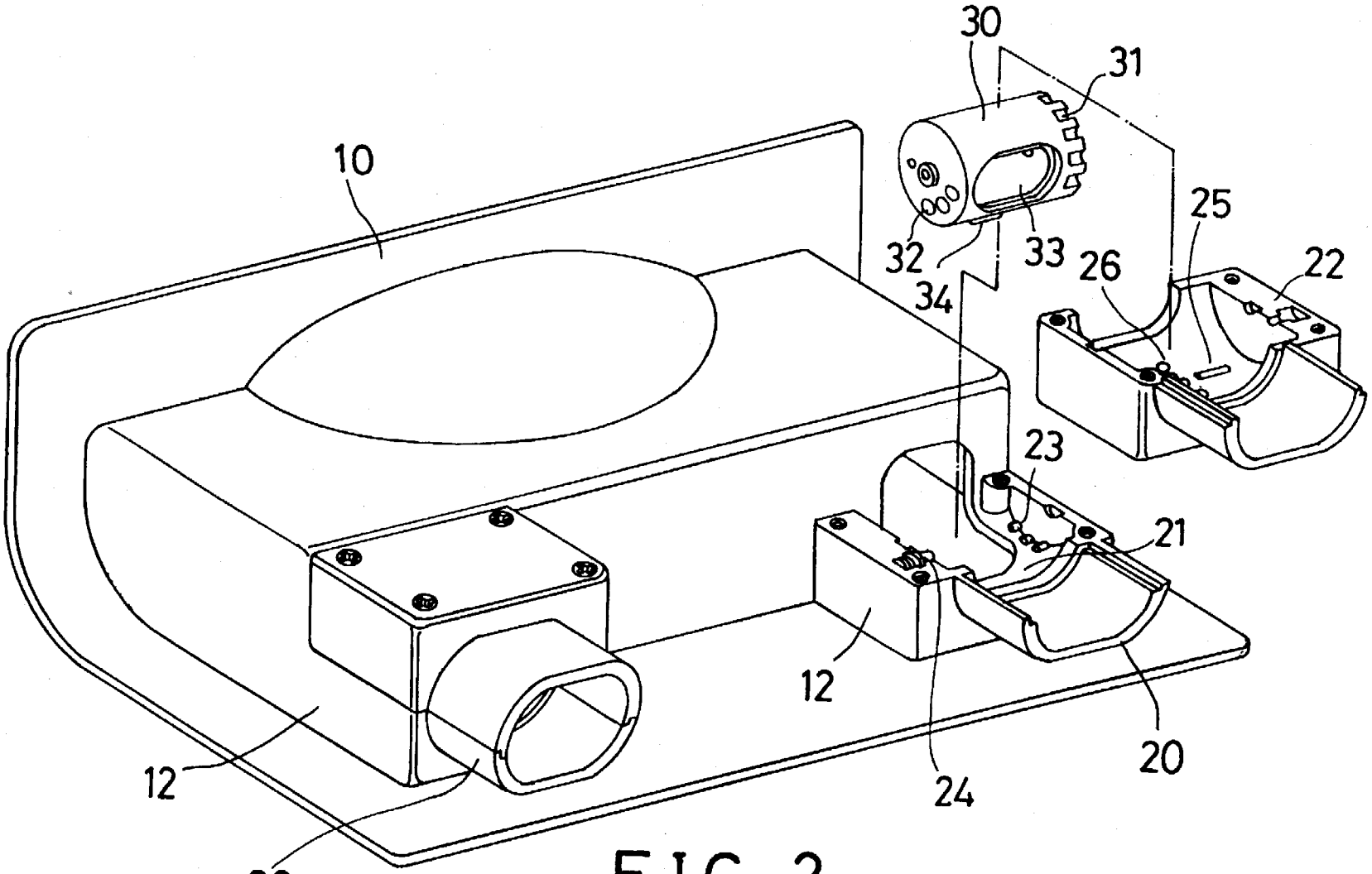
FIG. 2 is a rear partial exploded view of a housing for receiving the handle assembly.
Figure 3:
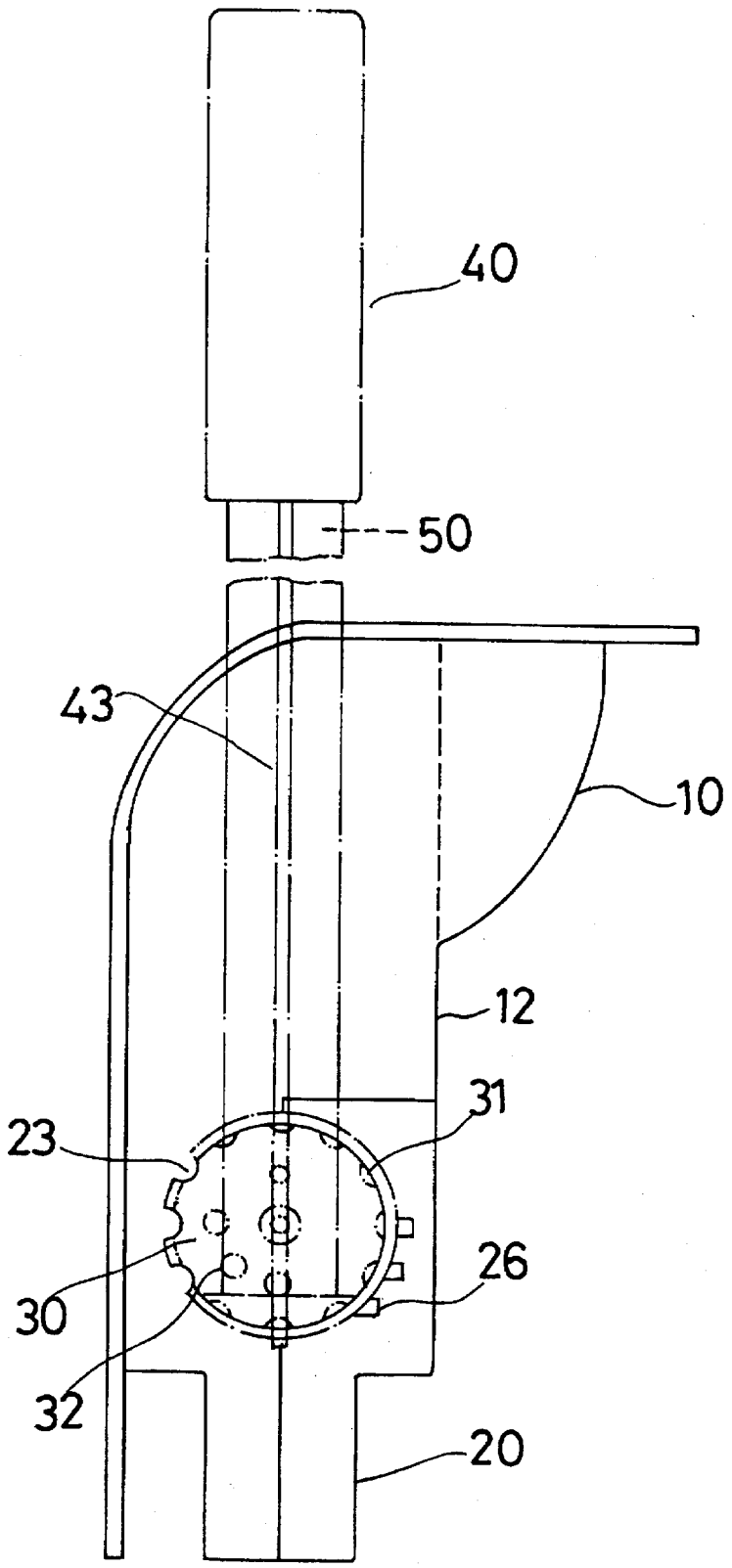
FIGS. 3 and 4 are schematic views illustrating the operation of the handle assembly.
Figure 4:
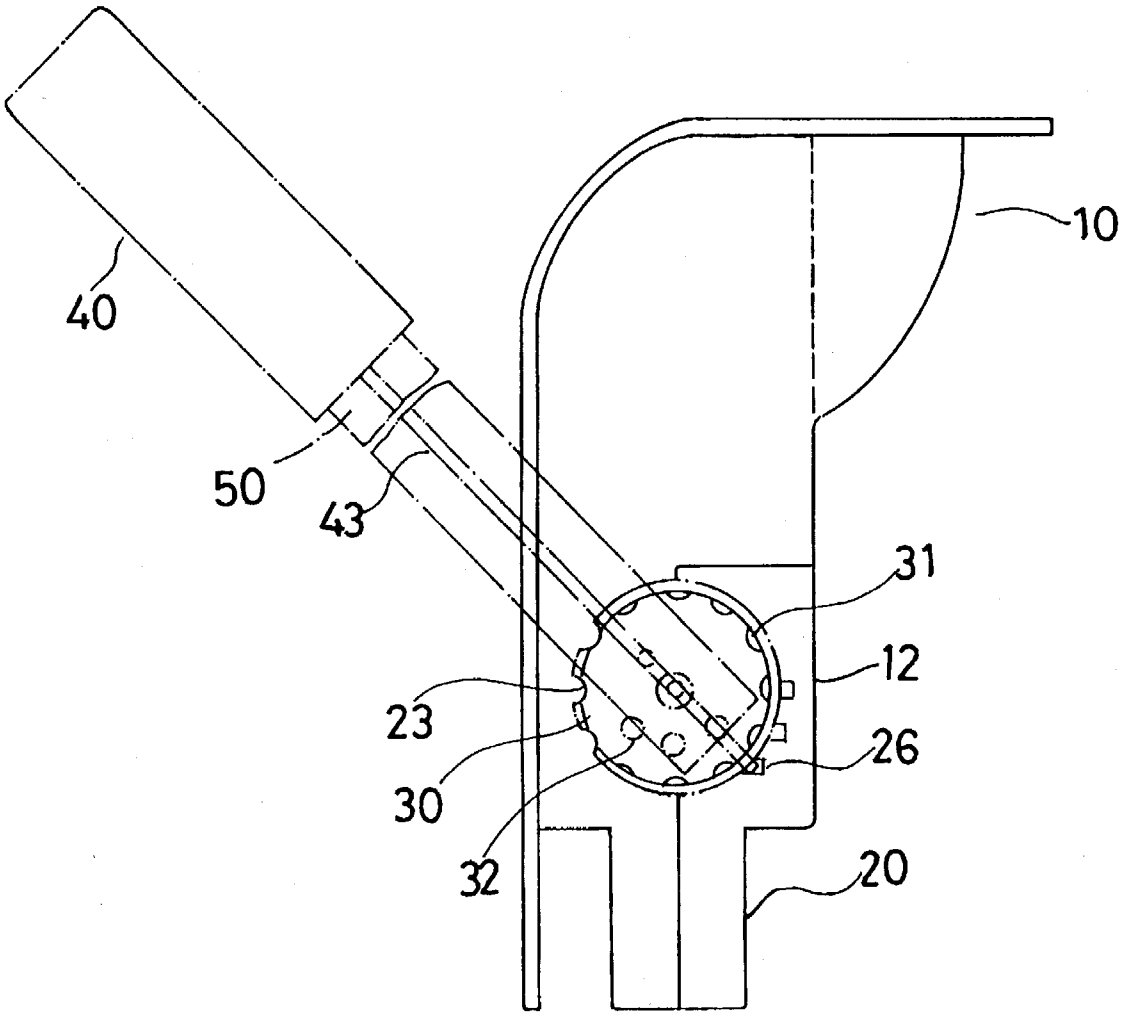
Figure 6:
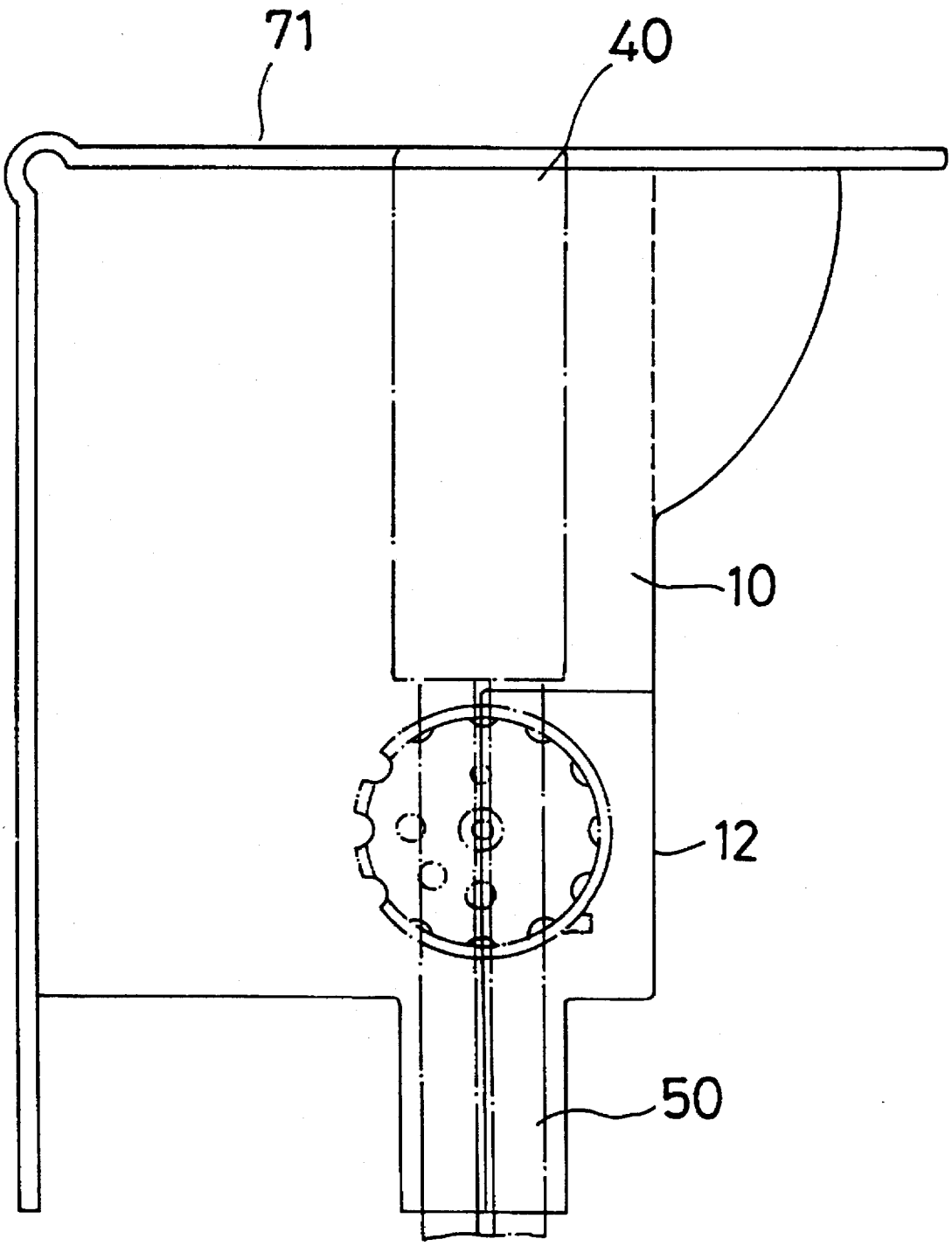
FIG. 6 is a schematic view similar to FIGS. 3 and 4, illustrating the application of the handle assembly.
Figure 7:
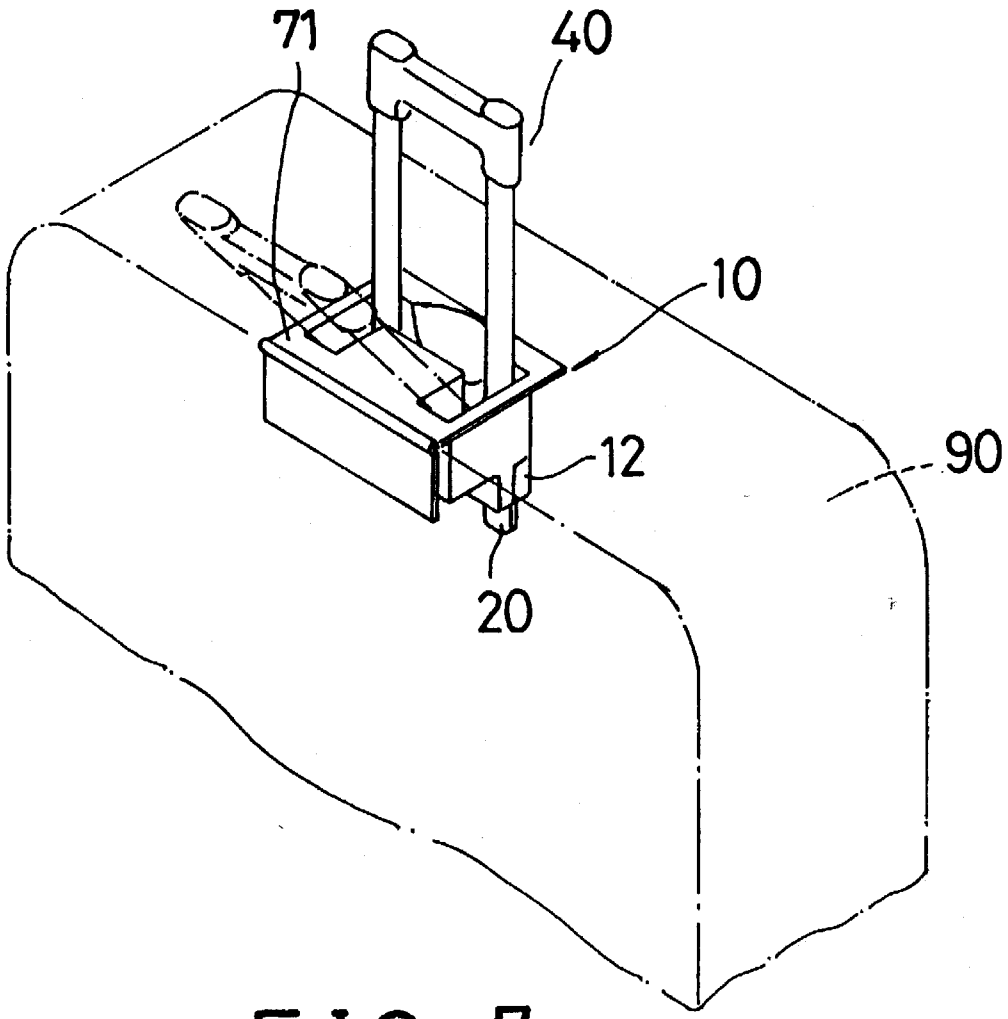
FIG. 7 is a perspective view illustrating the application of the handle assembly.

Referring to the drawings, and initially to FIGS. 1 to 3, a rotatable handle assembly for a suitcase in accordance with the present invention comprises a housing 10 for engaging in a suitcase 90 (FIG. 7) and including a room 11 (FIG. 5) formed therein for receiving a pair of tubes 50 therein. The housing 10 includes two casings 12 each having a downward extending conduit 20 for engaging onto a pipe 60 (FIG. 1) respectively. The tubes 50 are receivable in the pipes 60 in a retracted position (FIG. 6) and are extendible outward to an operating position (FIGS. 3, 4 and 7). The casings 12 each includes a chamber 21 (FIG. 2) formed therein and formed above the conduit 20 respectively for rotatably receiving a barrel 30 therein respectively. The casings 12 each includes a cap 22 secured thereto so as to define the chamber 21.

The barrels 30 each includes one or more cavities 32 formed in one end portion thereof and each includes a number of depressions 31 formed in the peripheral portion of the other end thereof. The casings 12 each includes a spring biased projection 24 (FIGS. 1 and 2) for engaging with either of the cavities 32 so as to position the barrel 30 at a suitable angular position relative to the casing 12. The casings 12 each also includes one or more bulges 23 (FIG. 2) formed therein for engaging with the depressions 31 of the barrel 30 so as to further position the barrel 30 at a suitable angular position relative to the casing 12. The barrels 30 each includes a swelling 34 extended outward therefrom for engaging with a stop 25 which is provided in the respective casing 12 so as to limit a rotational movement of the barrel 30 relative to the casing 12 and so as to prevent the barrel 30 from over rotating relative to the casing 12. The casings 12 each includes one or more punctures 26 (FIGS.

2 to 4) formed therein. The barrels 30 each includes an orifice 33 formed therein for engaging with the respective tube 50 therein, best shown in FIG. 1.

As best shown in FIG. 1, the barrels 30 each includes a bore 53 formed in the center portion and each includes an aperture 54 radially spaced from the bore 53. The tubes 50 each includes a lid 51 secured to the lower portion thereof. The lids 51 each includes a peripheral flange 511 formed thereon for engaging with the barrel 30 so as to prevent the tubes 50 from disengaging from the barrels 30 and the housing 10. The tubes 50 each includes a spring biased latch 52 provided in the lower portion thereof for engaging with either of the bore 53 or the aperture 54. When the latch 52 is engaged with the aperture 54, the lid 51 is disengaged from the pipe 60 and is received in the barrel 30 such that the barrel 30 and the tube 50 are rotatable relative to the casing 12 (FIGS. 1, 3 and 4). However, when the tube 50 is forced inward of the pipe 60 so as to engage the latch 52 with the bore 53, the lower end of the tube 50 is moved downward to be engaged in the pipe 60 such that the tube 50 and the barrel 30 may not be rotated relative to the casing 12.

Referring again to FIG. 1, the tubes 50 include a handle 40 secured on top thereof. The handle 40 includes a beam 44 provided therein and movable upward and downward. A hand grip 41 is secured to the beam 44 and extendible downward and outboard of the handle 40 for moving the beam 44 upward and downward. The handle 40 includes one or more springs 42 for biasing the beam 44 and the hand grip 41 downward. A pair of poles 43 are slidably received in the tubes 50 and each includes an upper end secured to the beam 44 so as to be moved upward and downward by the beam 44. The poles 43 each includes a lower end extended through the respective barrel 30 and the lid 51 for engaging with either of the punctures 26 (FIG. 4) so as to position the barrel 30 at a suitable angular position relative to the casing 12. As shown in the drawings, three punctures 26 are provided for engaging with the pole 43 such that the tubes 50 may be rotated to three different angular positions relative to the housing 10. The engagement of the spring biased projection 24 with either of the cavities 32 may also position the barrel 30 relative to the casing 12 at the three different angular positions. The engagement of the bulges 23 with the depressions 31 of the barrel 30 may also position the barrel 30 relative to the casing 12 at the three different angular positions.

Figure 5:
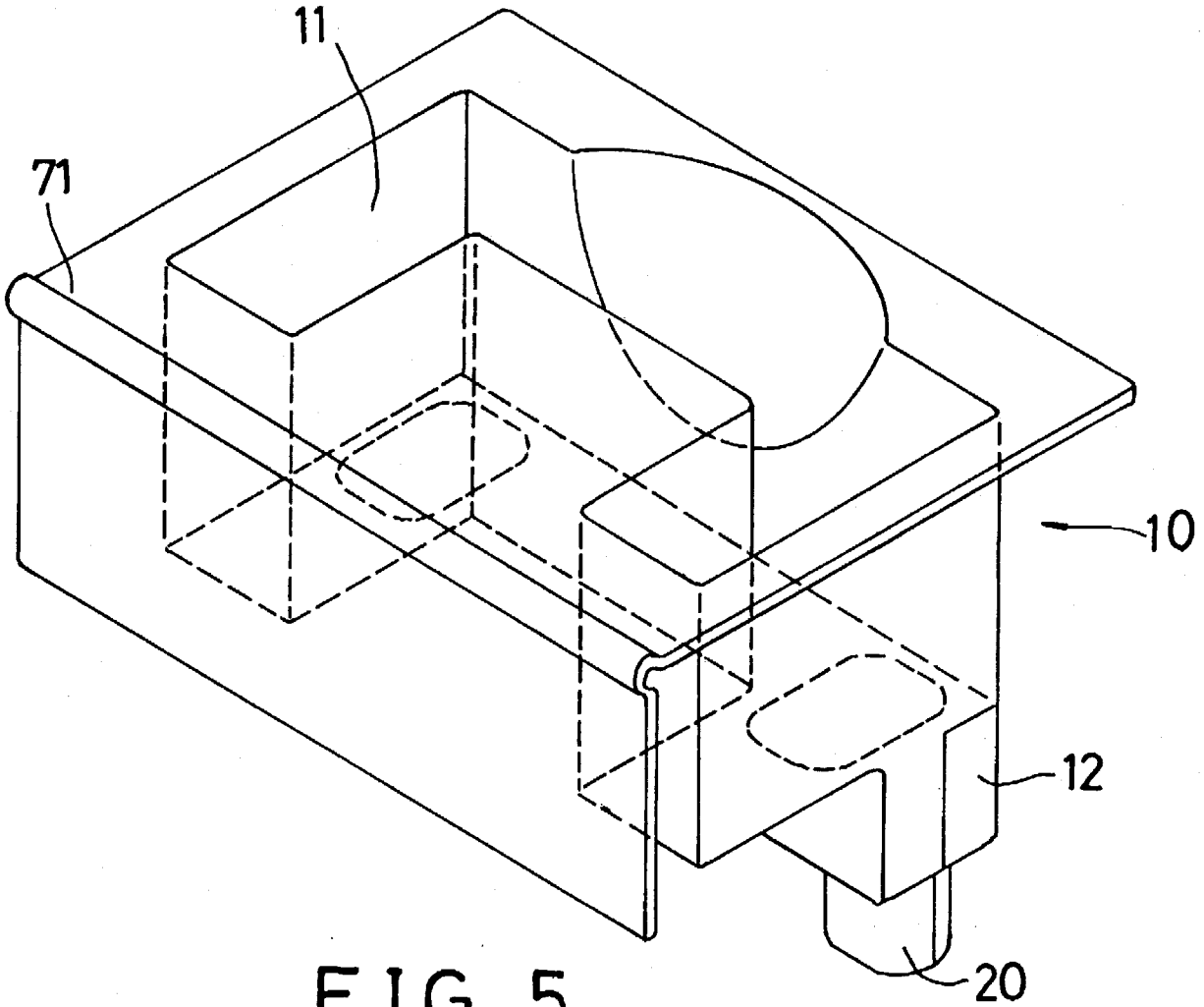
FIG. 5 is a perspective view of another application of the housing.

The housing 10 as shown in FIGS. 2 to 4 includes a curved front portion. However, the housing 10 as shown in FIGS. 5 to 7 includes an upper front portion having a right angle structure so as to form a flat upper surface 71. The handle 40 is flush with the flat upper surface 71 when the handle 40 is engaged in the housing 10.

Accordingly, the rotatable handle assembly in accordance with the present invention includes a pair of tubes that may be rotated to different angular position for facilitating the operation of the handle assembly.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A rotatable handle assembly for a suitcase, said handle assembly comprising:

a housing for engaging in the suitcase, said housing including a room formed therein and including a pair of casings formed therein, said casings each including a chamber formed therein, a pair of barrels rotatably received in said chambers of said casings, said barrels each including an orifice formed therein, a pair of tubes slidably received in said room, said tubes each including a lower portion slidably engaged through said orifice of said barrel so as to allow said tube to be rotated in concert with said barrel, and a handle secured on top of said tubes for operating said tubes;

said casings each including a conduit extended downward therefrom for receiving said tube, said tube and said barrel being allowed to rotate relative to said casing when said lower portion of said tube is disengaged from said conduit and when said lower portion of said tube is received in said barrel.

2. A handle assembly according to claim 1, wherein said barrel includes a center portion having a bore formed therein and includes an aperture formed therein and radially spaced from said bore, said tubes each includes a spring biased latch engaged therein for engaging with said bore when said lower portion of said tube is engaged in said conduit and for engaging with said aperture when said lower portion of said tube is disengaged from said conduit.

3. A handle assembly according to claim 1, wherein said lower portions of said tubes each includes a lid secured thereto, said lids each includes a peripheral flange formed thereon for engaging with said barrel so as to prevent said tubes from disengaging from said barrel and said housing.

4. A handle assembly according to claim 1, wherein said barrels each includes an end portion having at least one cavity formed therein, said casings each includes a projection means provided therein for engaging with said at least one cavity so as to position said barrel at an angular position relative to said casing.

5. A handle assembly according to claim 1, wherein said barrels each includes an end portion having a plurality of depressions formed therein, said casings each includes at least one bulge provided therein for engaging with said depressions so as to position said barrel at an angular position relative to said casing.

6. A handle assembly according to claim 1, wherein said casing includes at least one puncture formed therein, said handle includes a beam received therein and movable upward and downward and includes a biasing means for biasing said beam downward, said handle includes a hand grip secured to said beam and extendible downward and outward of said handle for moving said beam upward against said biasing means, said handle assembly further includes at least one pole slidably received in a first of said tubes, said pole includes an upper end secured to said beam so as to be moved upward and downward by said beam, said pole includes a lower end extended through said barrel for engaging with said puncture so as to position said barrel at an angular position relative to said casing.

7. A handle assembly according to claim 1, wherein said barrels each includes a swelling extended outward therefrom, said casings each includes a stop formed thereon for engaging with said swelling of said barrel so as to limit a rotational movement of said barrel relative to said casing.

* * * * *